US006055918A

United States Patent [19]

Hajjar et al.

[11] Patent Number: 6,055,918

[45] Date of Patent: May 2, 2000

[54] PORTABLE CARPET BINDER

[75] Inventors: Akl Hajjar, Chatham; Melvin Maher, East Hanover, both of N.J.

[73] Assignee: N.C. Carpet Binding & Equipment Corporation, Newark, N.J.

[21] Appl. No.: 09/109,253

[22] Filed: Jun. 30, 1998

[51] Int. Cl.[7] ..... D05B 27/14; D05B 35/06

[52] U.S. Cl. ..... 112/7; 112/137; 112/169; 112/322

[58] Field of Search ..... 112/7, 137, 169, 112/80.03, 318, 322, 152, 104, 9

[56] References Cited

U.S. PATENT DOCUMENTS

| | | | |
|---|---|---|---|
| 2,547,821 | 4/1951 | Hartwell | 112/7 |
| 4,062,307 | 12/1977 | Michelberger | 112/7 |
| 4,290,376 | 9/1981 | Brusasca et al. | 112/322 X |
| 5,020,458 | 6/1991 | Michelberger | 112/7 |
| 5,209,171 | 5/1993 | Anderson | 112/7 |
| 5,331,910 | 7/1994 | Mukai et al. | 112/322 X |
| 5,875,723 | 3/1999 | Lobur | 112/7 |

*Primary Examiner*—Peter Nerbun
*Attorney, Agent, or Firm*—Gibbons, Del Deo, Dolan Griffinger & Vecchione

[57] ABSTRACT

A portable carpet binder applies and sews a binding tape to a carpet edge. The binder includes a sewing head having a carpet support table, a sewing mechanism, a motor, means for folding the binding tape over the carpet edge, and wheels to move the carpet binder on a floor. The binder operates using a puller having a U-shaped puller bracket, means for mounting the puller bracket on the sewing head above the table, a first longitudinally serrated roller rotatably mounted on the puller bracket, a second longitudinally serrated roller rotatably mounted on the puller bracket parallel to the first roller, and coupling means for rotatably and synchronously coupling the first roller to the second roller so as to transfer rotary motion from the first roller to the second roller. Also provided are driving means for intermittently driving the puller in unidirectional rotation, and timing means for adjusting a timing relation between the driving means and the sewing mechanism.

16 Claims, 3 Drawing Sheets

PORTABLE CARPET BINDER

FIELD OF THE INVENTION

This invention relates generally to the field of sewing machines, and pertains, more specifically, to the field of machines for sewing a binding tape to the cut edge of a carpet to prevent fraying of the carpet edge.

BACKGROUND OF THE INVENTION

Floor carpeting is commonly cut from a large roll, leaving a raw edge subject to fraying and unraveling. The typical solution is to fold a length of binding tape longitudinally over the cut edge, and sew the tape to the carpet edge. An apparatus known as a puller draws the carpet through a sewing mechanism or, in the case of a portable binder, advances the machine along the carpet edge. The puller is typically a roller connected to a drive motor, the roller having longitudinal serrations or teeth to grip the carpet. The binding tape is payed out through a folder which folds it lengthwise and applies the tape to the carpet edge. The sewing mechanism then sews the binding tape to the carpet in a continuous process. Machines to carry out this procedure are known and, heretofore, have been configured in different ways. Some examples of carpet binding machines are seen in the following U.S. patents and catalogs:

Hartwell, U.S. Pat. No. 2,547,821, and Anderson, U.S. Pat. No. 5,209,171, are both sewing machines mounted on a wheeled base, utilizing a puller having a single roller above the carpet.

Similarly, Michelberger, U.S. Pat. No. 4,062,307, shows a sewing machine mounted on a wheeled base, but employs a puller with a single roller below the carpet, and an idler wheel above.

Michelberger, U.S. Pat. No. 5,020,458, discloses a wheeled machine having a puller with a flat, serrated plate moving in an oval path in the manner of a walking foot, below the carpet.

A catalog from Binders Group Inc., of Parma, Ohio, illustrates a carpet binding machine on wheels, model BG-3WP, having a puller with a single roller mounted below the carpet.

A catalog from NC Binding and Equipment Corp., of Newark, N.J.; depicts two portable machines. The model PBS-2A binder uses a single roller type puller mounted above the carpet. The model PBT-2A binder has two separately mounted pullers above the carpet, with separate mounts, drives and clutches.

The above-described machines display shortcomings in securely attaching tape to a carpet edge. Pullers mounted above the carpet provide more traction upon the carpet surface than those mounted below and therefore are more advantageous. Furthermore, the double puller delivers more traction than the single puller. The double puller is more directionally stable, as it does not tend to walk off the edge of the carpet. The NC model PBT-2A binder is thus superior to the other machines described above. A disadvantage of this model is that the two puller rollers are not always synchronized because each roller is controlled by separate clutches and drives. The duplication of parts is expensive, increases the weight of the portable machine, and adds to maintenance. Accordingly, there is a need to provide a portable carpet binder with two pullers for more traction and stability, yet having better synchronization with fewer mounting and driving components.

SUMMARY OF THE INVENTION

In accordance with the present invention, there is provided a portable carpet binder for applying and sewing a binding tape to a carpet edge. The carpet binder comprises a sewing head having a frame. A carpet support table is mounted on the frame and a sewing mechanism is attached to the frame. The sewing mechanism includes a needle for generating stitches. A flywheel having an axis of rotation is rotatably mounted on the frame and drivingly connected to the sewing mechanism. A motor, mounted on the frame, is rotatably connected to the flywheel by a connecting means. Binding tape is folded over the carpet edge by being driven through a folding means which is attached to the sewing head. At least one thread holder is attached to the frame to supply thread to the sewing mechanism. A binding tape holder attached to the frame supplies the binding tape to the carpet edge.

A puller having a U-shaped puller bracket is attached by a mounting means to the frame above the carpet support table. A first longitudinally serrated roller is rotatably mounted on the puller bracket. A second longitudinally serrated roller is rotatably mounted on the puller bracket parallel to the first roller. A coupling means rotatably and synchronously couples the first roller to the second roller so as to transfer rotary motion from the first roller to the second roller. A driveshaft having a rear end and an opposite forward end connected to the puller, rotatably drives the rollers.

A driving means intermittently drives the driveshaft in unidirectional rotation. A timing means, rotatably coupled to the flywheel for concurrent rotation therewith, is drivingly connected to the driving means, for adjusting a timing relation between the driving means and the sewing mechanism. This causes the puller to hold the carpet against the table and forces movement of the carpet binder along the carpet edge, whereby the sewing mechanism will sew the binding tape to the carpet edge. Wheels are mounted on a lower portion of the frame for enabling movement of the carpet binder on a floor.

The portable carpet binder utilizes a double roller type puller driven by a single driveshaft. An advantage of the single driveshaft design of this invention is that the first and second longitudinally serrated rollers move synchronously along the edge of the carpet. The double roller system is directionally stable and maximizes traction. Furthermore, the use of a single driveshaft with a coupling means reduces expense, weight and maintenance of the portable carpet binder.

Additionally, the timing mechanism allows for the intermittent advancement of the machine along the edge of the carpet. This feature is advantageous in preventing the carpet from becoming wedged in the machine and allowing for the smooth operation of the sewing mechanism.

BRIEF DESCRIPTION OF THE DRAWINGS

A more complete understanding of the present invention may be obtained from consideration of the following description in conjunction with the drawings in which.

DETAILED DESCRIPTION OF VARIOUS ILLUSTRATIVE EMBODIMENTS

Figure 1:
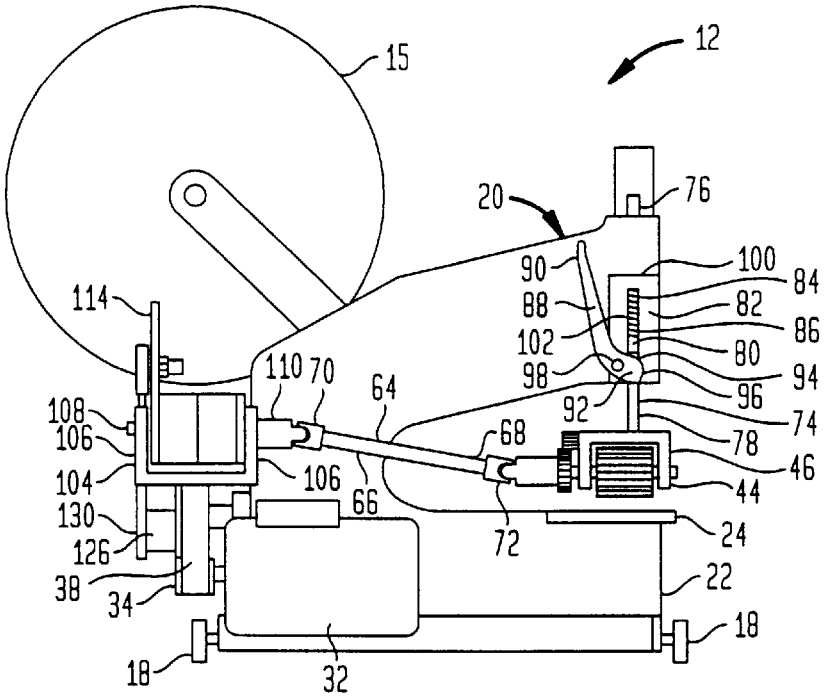
FIG. 1 is a left side elevational view of a portable carpet binder constructed in accordance with the invention.

Referring now to the drawings, and especially to FIGS. 1, 2, 3 and 4 thereof, a portable carpet binder is shown at 12, and is used for applying and sewing a binding tape 14 to the edge of a carpet (not shown). The carpet binder 12 comprises a sewing head 20 having a frame 22, and a carpet support table 24 mounted on the frame 22. A sewing mechanism 26 is attached to the frame 22, and includes a needle 28 for generating stitches. A flywheel 30, having an axis of rotation, is rotatably mounted on the frame 22. The flywheel 30 is drivingly connected to the sewing mechanism 26. A motor 32 is mounted on the frame 22. Connecting means is provided for rotatably connecting she motor 32 to the flywheel 30. Specifically, the connecting means comprises a driver pulley 34 attached to the motor 32, a driven pulley 36 attached to the flywheel 30, and a belt 38 connecting the driver pulley 34 to the driven pulley 36. The belt 38 is preferably a timing belt.

A folding means 16, is attached to the sewing head 20, for folding the binding tape 14 over the carpet edge. Wheels 18 are mounted on a lower portion of the frame 22 for enabling movement of the carpet binder 12 on a floor. A handle 19 is attached to the frame 22 to guide the movement along the carpet edge. At least one thread holder 40, is attached to the frame 22 for supplying thread 42 to the sewing mechanism 26. Typically, two thread holders are used, one to supply thread to the needle, and a second to supply thread to the looping mechanism (not shown) below the table. The thread holders are omitted from FIG. 1 for clarity. Thread spool bases 41 are outlined in FIG. 2 to show their position. A binding tape holder 15 is attached to the frame 22 for supplying the binding tape 14 to the carpet edge.

Figure 6:
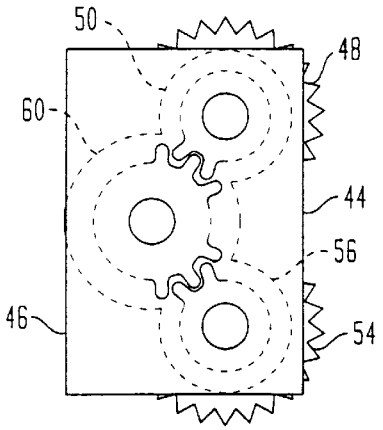
FIG. 6 is an end view of the double roller type puller of FIG. 5.
Figure 5:
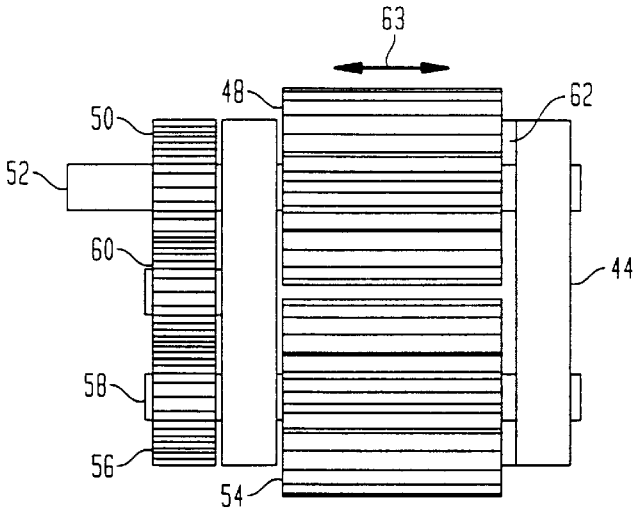
FIG. 5 is a bottom view of a double roller type puller constructed in accordance with the invention.

The carpet is advanced through the sewing mechanism 26 by means of a double roller configuration puller as shown in FIGS. 5 and 6. A puller 44 serves to hold the carpet down on the table 24, to pull the binder 12 across the floor, and to advance the carpet through the sewing mechanism 26. The puller 44 has a U-shaped puller bracket 46. The puller 44 has a first longitudinally serrated roller 48, and a first pinion 50. A first roller shaft 52 is rotatably mounted in the puller bracket 46, and the first roller 48 and the first pinion 50 are mounted on the first roller shaft 52 and are keyed to the shaft for rotation therewith. The puller 44 includes a second longitudinally serrated roller 54, and a second pinion 56. A second roller shaft 58 is rotatably mounted in the puller bracket 46 parallel to the first roller shaft 52. The second roller 54 and the second pinion 56 are mounted on the second roller shaft 58 and are keyed to the shaft for rotation therewith. A transfer gear 60 is rotatably mounted on the puller bracket 44 and engages the first 50 and second 56 pinions for rotation therewith, so as to transfer rotary motion synchronously from the first roller 48 to the second roller 54. A driveshaft 64 is provided, having a rear end 66 and an opposite forward end 68 connected to the puller 44, for rotatably driving the rollers 48, 54. The first roller 54 and the puller bracket 46 have a predetermined end clearance 62 therebetween. The first roller shaft 52 is axially slideable within the roller bracket 44, as shown by arrow 63 so as to compensate for forward and rearward movement of the driveshaft forward end 68 as the puller 44 moves upward and downward.

Referring now to FIG. 1, a mounting means for mounting the puller bracket 46 on the frame 22 is provided. The mounting means comprises a generally vertical puller bar 74 having opposite upper 76 and lower 78 ends. The puller bar 74 is mounted for generally vertical sliding movement in the frame 22 above the table 24. The puller bracket 46 is mounted on the lower end 78 of the puller bar 74. A lug 80 projects outward from the puller bar 74 intermediate the ends thereof A coil spring 82 slidingly engages the puller bar 74. The spring 82 has an upper end 84 bearing upward against the frame 22, and a lower end 86 bearing downward against the lug 80 to bias the puller bar 74 downward. A lift lever 88 is pivotally mounted on the frame 22 at a pivot point 98 intermediate of proximal 90 and distal 92 arms of the lever. An upper edge 94 of the lift lever distal arm 92 engages the lug 80 so as to raise the lug 80 upon pivoting of the lift lever 88. The distal end 96 of the lift lever distal arm 92 is configured generally flat and tangential to the pivot point 98, so as to support the lug 80 in the raised position. A guide plate 100 is mounted on the frame 22 adjacent the puller bar 74. The guide plate 100 has a generally vertical slot 102. The lug 80 slidingly engages the slot 102 to prevent rotation of the lug 80 and puller bar 74.

The portable carpet binder includes driving means to transmit power from the flywheel to the puller by intermittently driving the driveshaft in unidirectional rotation. Timing means is also provided, and is rotatably coupled to the flywheel for concurrent rotation therewith. The timing means is drivingly connected to the driving means, and is used for adjusting a timing relation between the driving means and the sewing mechanism. Thus, the carpet is advanced when the needle is raised, and the carpet is motionless when the needle is thrust downward to form a stitch.

Figure 2:
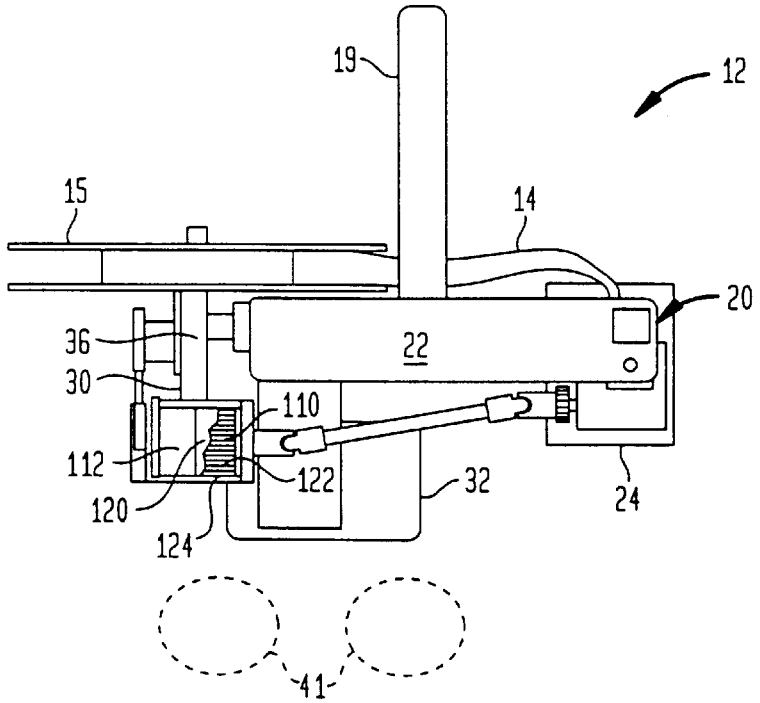
FIG. 2 is a top view of the portable carpet binder of FIG. 1.
Figure 3:
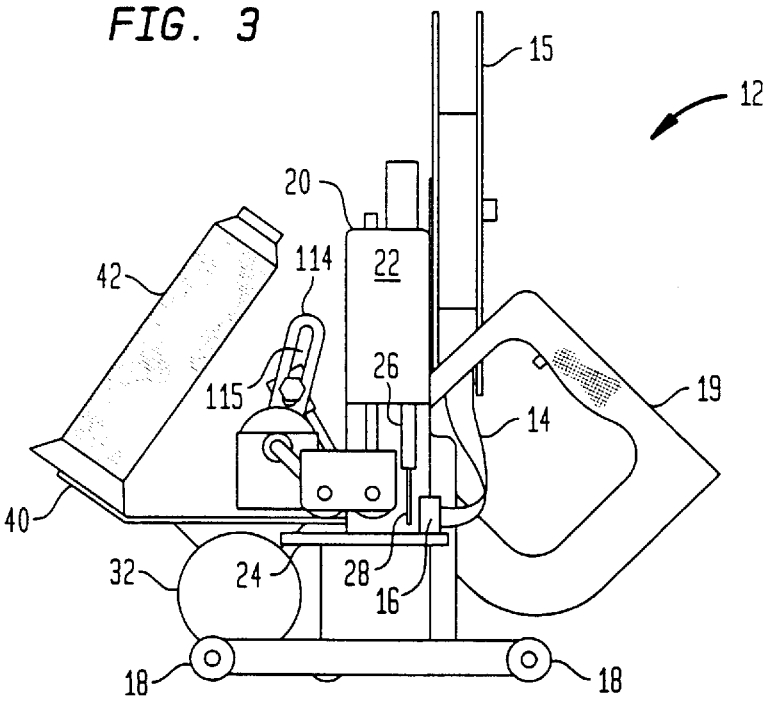
FIG. 3 is a front elevational view of the portable carpet binder of FIG. 1.

Turning now to FIGS. 1, 2 and 3, the driving means includes a U-shaped clutch bracket 104 mounted on the frame 22 adjacent the flywheel 30. A clutch shaft 108 is rotatably mounted in projecting flanges 106 of the clutch bracket 104. A first universal joint 70 connects an output end 110 of the clutch shaft 108 to the driveshaft rear end 66. A second universal joint 72 connects the first roller shaft 52 of the puller 44 to the driveshaft forward end 68. A unidirectional first clutch 112 is drivingly mounted on the clutch shaft 108, and an input lever 114 is rotatably mounted on the first clutch 112. Thus, as the input lever 114 is moved in a first direction, shown by arrow 116 in FIG. 4, from a starting position through a predetermined angle to an ending position, the driveshaft 64 will be rotatably driven in the first direction 116. Conversely, as the input lever 114 is moved in a second direction, shown by arrow 118, from the ending position to the starting position, the driveshaft 64 will not move.

The driving means includes an optional unidirectional second clutch 120 having an inner element 122 mounted on the clutch shaft 108 for rotation therewith. The second clutch 120 has an outer element 124 secured against rotation, so that the second clutch 120 will slip in the first direction 116, allowing the clutch shaft 108 to rotate in the first direction 116. The second clutch 120 will engage in the second direction 118, preventing the clutch shaft 108 from rotating in the second direction 118, thereby forming a brake to prevent backward movement of the puller 44.

Figure 4:
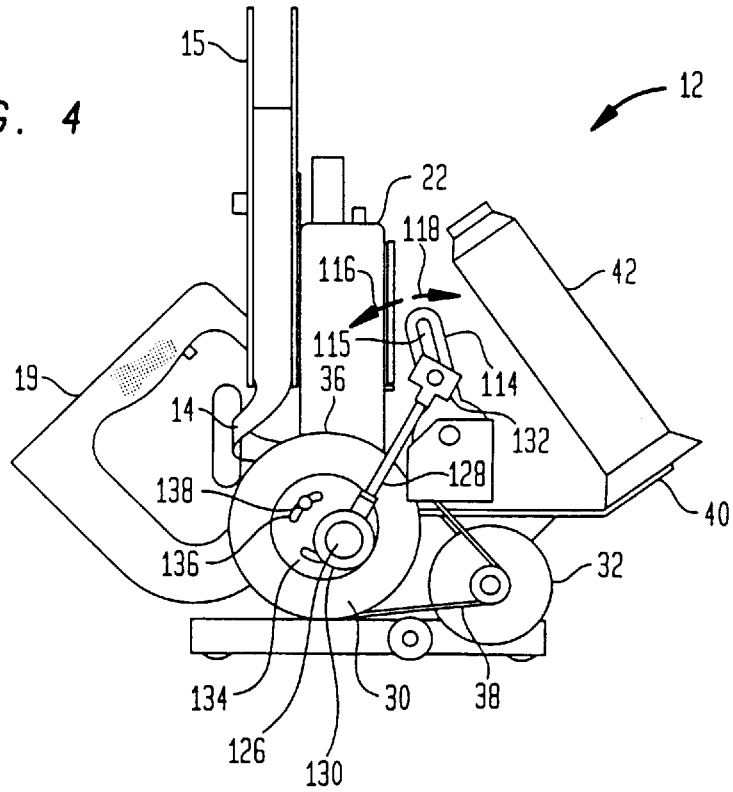
FIG. 4 is a rear elevational view of the portable carpet binder of FIG. 1.

An eccentric journal 126 is mounted on the timing means a predetermined distance from the axis of rotation thereof. A connecting rod 128 is shown in FIG. 4, and has opposite first 130 and second 132 ends. The connecting rod first end 130 is rotatably mounted on the eccentric journal 126. The second end 132 is pivotally mounted in a radial slot 115 on the input lever 114. Thus, the angular movement of the input lever 114 is adjusted by adjusting the radial position of the connecting rod second end 132 on the input lever 114. As the flywheel 30 is then rotated one revolution, the input lever 114 will be moved from the starting position to the ending position and back to the starting position, thereby causing intermittent movement of the puller 44 in timed relation to the operation of the sewing mechanism 26.

The timing means includes a generally circular timing plate 134 mounted concentrically to the flywheel 30. The timing plate 134 has a plurality of arcuate slots 136 therethrough, which are concentric with the flywheel axis of rotation. The slots 136 are uniformly spaced around the timing plate 134 adjacent the periphery thereof. A plurality of screws 138 fasten the timing plate 134 to the flywheel 30 through the slots 136. Thus, when the screws 138 are loosened, the timing plate 134 can be rotated to adjust the timing relation between the driving means and the sewing mechanism 26, and the screws 138 will be tightened to secure the timing plate 134.

In operation, the driving means and the timing means will cause the first roller 48 to rotate intermittently in timed relation with the sewing mechanism 26. The pinions 50 and 56 and transfer gear 60 will couple this rotation to the second roller 54 which will then rotate in synchronization with the first roller 48. The puller 44 will hold the carpet against the table 24 and will cause movement of the carpet binder 12 along the carpet edge, whereby the sewing mechanism 26 will sew the binding tape 14 to the carpet edge.

Figure 8:
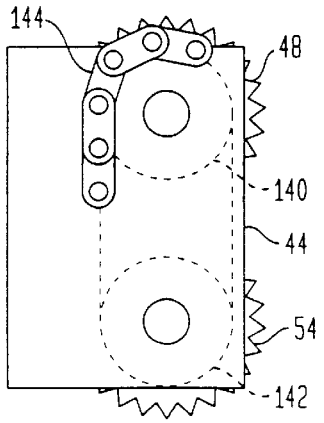
FIG. 8 is an end view of the double roller type puller of FIG. 7.
Figure 7:
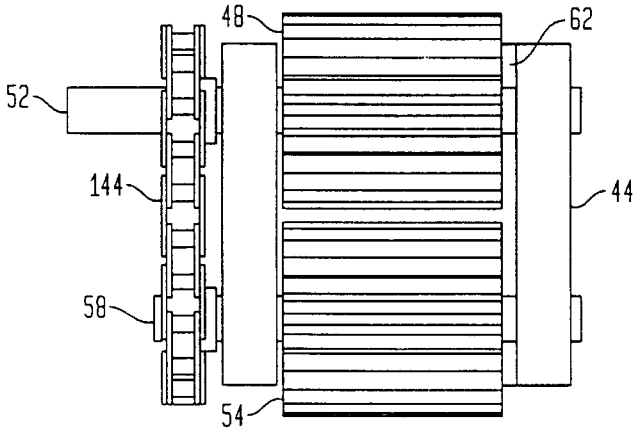
FIG. 7 is a bottom view of another double roller type puller constructed in accordance with the invention.

Turning now to FIGS. 7 and 8, as well as FIGS. 1, 2, 3 and 4, another puller constructed in accordance with the invention is shown at 44. The puller of FIG. 7 differs from that of FIG. 5 in the way the rollers are rotatably coupled. The puller 44 has a first sprocket 140 mounted on the first roller shaft 52 along with the first roller 48 and keyed to the shaft for rotation therewith. A second sprocket 142 is mounted on the second roller shaft 58 along with the second roller 54 and is keyed to the shaft for rotation therewith. A chain 144, preferably a roller chain, is mounted on the first 140 and second 142 sprockets for rotation therewith, so as to transfer rotary motion synchronously from the first roller 48 to the second roller 54.

Figure 10:
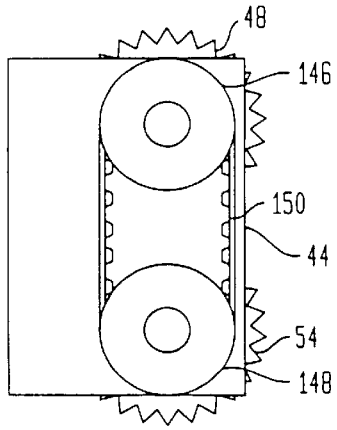
FIG. 10 is an end view of the double roller type puller of FIG. 9.
Figure 9:
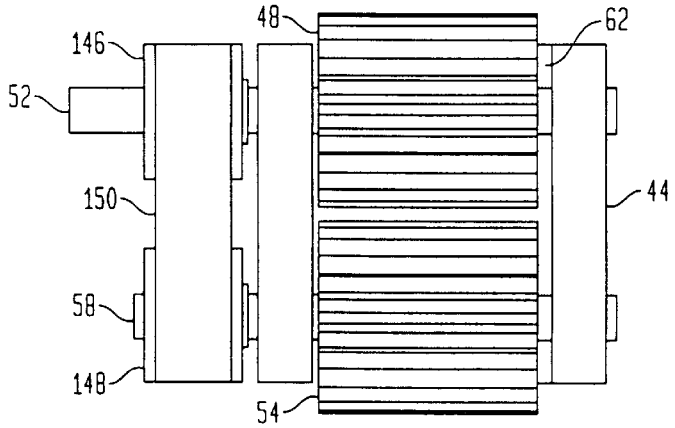
FIG. 9 is a bottom view of yet another double roller type puller constructed in accordance with the invention.

Turning now to FIGS. 9 and 10, as well as FIGS. 1, 2, 3 and 4, another puller constructed in accordance with the invention is shown at 44. The puller of FIG. 9 differs from those of FIGS. 5 and 7 in the way the rollers are rotatably coupled. The puller 44 has a first pulley 146 mounted on the first roller shaft 52 along with the first roller 48 and keyed to the shaft for rotation therewith. A second pulley 148 is mounted on the second roller shaft 58 along with the second roller 54 and is keyed to the shaft for rotation therewith. A belt 150, preferably a timing belt, is mounted on the first 146 and second 148 pulleys for rotation therewith, so as to transfer rotary motion synchronously from the first roller 48 to the second roller 54.

As seen from the foregoing description, the present invention satisfies the need to provide a portable carpet binder with two pullers for more traction and stability, yet having better synchronization with fewer mounting and driving components.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications which come within the scope of the appended claims is reserved.

What is claimed:

1. A portable carpet binder for applying and sewing a binding tape to a carpet edge, the carpet binder comprising:

a sewing head having a frame, a sewing mechanism attached to the frame, folding means, attached to the sewing head, for folding the binding tape over the carpet edge;

at least one thread holder attached to the frame for supplying thread to the sewing mechanism;

a binding tape holder attached to the frame for supplying the binding tape to the carpet edge;

a puller having a puller bracket, mounting means for mounting the puller bracket on the frame, a first roller rotatably mounted on the puller bracket, a second roller rotatably mounted on the puller bracket, coupling means for rotatably and synchronously coupling the first roller to the second roller;

a driveshaft having a rear end and an opposite forward end connected to the puller, for rotatably driving the rollers;

driving means coupled to said rear end for intermittently driving the driveshaft in unidirectional rotation; and timing means drivingly connected to the driving means, for adjusting a timing relation between the driving means and the sewing mechanism; wherein the puller will cause movement of the carpet binder along the carpet edge and the sewing mechanism will sew the binding tape to the carpet edge.

2. The portable carpet binder of claim 1, further comprising a flywheel having an axis of rotation, the flywheel rotatably mounted on the frame, the flywheel drivingly connected to the sewing mechanism.

3. The portable carpet binder of claim 2, further comprising a motor mounted on the frame and connecting means for rotatably connecting the motor to the flywheel.

4. The portable carpet binder of claim 1 further comprising a carpet support table mounted on the frame.

5. The portable carpet binder of claim 1 further comprising a plurality of wheels mounted on a lower portion of the frame for enabling movement of the carpet binder on the floor.

6. The portable carpet binder of claim 1, wherein the mounting means further comprises:

a generally vertical puller bar having opposite upper and lower ends, the puller bar mounted for generally vertical sliding movement in the frame, the puller bracket mounted on the lower end of the puller bar;

a lug projecting outward from the puller bar intermediate the ends thereof;

a coil spring slidingly engaging the puller bar, a spring upper end bearing upward against the frame, a spring lower end bearing downward against the lug to bias the puller bar downward;

a lift lever pivotally mounted on the frame at a pivot point intermediate of proximal and distal arms of the lift lever, an upper edge of the distal arm of the lift lever engaging the lug so as to raise the lug upon pivoting of the lift lever, a distal end of the distal arm of the lift lever being configured generally flat and tangential to the pivot point, so as to support the lug in the raised position; and a guide plate mounted on the frame adjacent the puller bar, the guide plate having a generally vertical slot, the lug slidingly engaging the slot to prevent rotation of the lug and puller bar.

7. The portable carpet binder of claim 1, wherein the puller further comprises:

a first roller shaft rotatably mounted in the puller bracket, the first roller mounted on the first roller shaft for rotation therewith, the first roller and the puller bracket having a predetermined end clearance therebetween, the first roller shaft axially slideable within the roller bracket so as to compensate for forward and rearward movement of the driveshaft forward end as the puller moves upward and downward; and a second roller shaft rotatably mounted in the puller bracket, the second roller mounted on the second roller shaft for rotation therewith.

8. The portable carpet binder of claim 1, wherein the coupling means comprises:

a first pinion rotatably coupled to the first roller;

a second pinion rotatably coupled to the second roller; and a transfer gear rotatably mounted on the puller bracket and engaging the first and second pinions for rotation therewith.

9. The portable carpet binder of claim 1, wherein the coupling means comprises:

a first sprocket rotatably coupled to the first roller;

a second sprocket rotatably coupled to the second roller; and a chain mounted on the first and second sprockets for rotation therewith.

10. The portable carpet binder of claim 1, wherein the coupling means comprises:

a first pulley rotatably coupled to the first roller;

a second pulley rotatably coupled to the second roller; and a belt mounted on the first and second pulleys for rotation therewith.

11. The portable carpet binder of claim 2, wherein the timing means further comprises:

a generally circular timing plate mounted concentrically to the flywheel, the timing plate having a plurality of arcuate slots therethrough, the slots being concentric with the flywheel axis of rotation, the slots uniformly spaced around the timing plate adjacent to the periphery thereof; and a plurality of screws fastening the timing plate to the flywheel through the slots, so that the screws will be loosened, the timing plate will be rotated to adjust the timing relation between the driving means and the sewing mechanism, and the screws will be tightened to secure the timing plate.

12. The portable carpet binder of claim 2, wherein the driving means further comprises:

a clutch bracket mounted on the frame adjacent the flywheel;

a clutch shaft rotatably mounted in projecting flanges of the clutch bracket;

a first universal joint connecting an output end of the clutch shaft to the driveshaft rear end;

a second universal joint connecting the puller to the driveshaft forward end;

a unidirectional first clutch drivingly mounted on the clutch shaft, and an input lever rotatably mounted on the first clutch, so that as the input lever is moved in a first direction from a starting position through a predetermined angle to an ending position, the driveshaft will be rotatably driven in the first direction, and as the input lever is moved in a second direction from the ending position to the starting position, the driveshaft will not move;

an eccentric journal mounted on the timing means a predetermined distance from the axis of rotation thereof; and a connecting rod having opposite first and second ends, the first end rotatably mounted on the eccentric journal, the second end pivotally mounted in a radial slot on the input lever so that the angular movement of the input lever is adjusted by adjusting the radial position of the connecting rod second end on the input lever, such that as the flywheel is rotates one revolution, the input lever will be moved from the starting position to the ending position and back to the starting position, wherein the puller moves in timed relation to the operation of the sewing mechanism.

13. The portable carpet binder of claim 12, wherein the driving means further comprises a unidirectional second clutch having an inner element mounted on the clutch shaft for rotation therewith, the second clutch having an outer element secured against rotation, so that the second clutch will slip in the first direction, allowing the clutch shaft to rotate in the first direction, and the second clutch will engage in the second direction, preventing the clutch shaft from rotating in the second direction, thereby forming a brake to prevent backward movement of the puller.

14. A portable carpet binder for applying and sewing a binding tape to a carpet edge, the carpet binder comprising:

a sewing head having a frame, a carpet support table mounted on the frame, a sewing mechanism attached to the frame, the sewing mechanism including a needle for generating stitches, a flywheel having an axis of rotation, the flywheel rotatably mounted on the frame, the flywheel drivingly connected to the sewing mechanism, a motor mounted on the frame, connecting means for rotatably connecting the motor to the flywheel, folding means, attached to the sewing head, for folding the binding tape over the carpet edge, and wheels mounted on a lower portion of the frame for enabling movement of the carpet binder on a floor;

at least one thread holder attached to the frame for supplying thread to the sewing mechanism;

a binding tape holder attached to the frame for supplying the binding tape to the carpet edge;

a puller having a puller bracket, mounting means for mounting the puller bracket on the frame above the table, a first roller rotatably mounted on the puller bracket, a second roller rotatably mounted on the puller bracket, coupling means for rotatably and synchronously coupling the first roller to the second roller, and a driveshaft having a rear end and an opposite forward end connected to the puller, for rotatably driving the rollers;

driving means for intermittently driving the driveshaft in unidirectional rotation; and timing means, rotatably coupled to the flywheel for concurrent rotation therewith, the timing means drivingly connected to the driving means, for adjusting a timing relation between the driving means and the sewing mechanism; wherein the puller will hold the carpet against the table and will cause movement of the carpet binder along the carpet edge and the sewing mechanism will sew the binding tape to the carpet edge.

15. The portable carpet binder of claim 3, wherein the connecting means further comprises:

a driver pulley attached to the motor;

a driven pulley attached to the flywheel; and a belt connecting the driver pulley to the driven pulley.

16. A portable carpet binder for applying and sewing a binding tape to a carpet edge, the carpet binder comprising:

a sewing means mounted to a frame;

a puller mounted to said frame having a puller bracket, a first roller rotatable mounted on the puller bracket, a second roller rotatable mounted on the puller bracket, and coupling means for rotatably and synchronously coupling the first roller to the second roller;

driving means for rotatable driving said first and second rollers; and one driveshaft having a rear end coupled to said driving means and an opposite forward end connected to the puller, for rotatably driving the rollers.

* * * * *